US006820356B2

(12) United States Patent
Naruse et al.

(10) Patent No.: US 6,820,356 B2
(45) Date of Patent: Nov. 23, 2004

(54) HYBRID POWERED CONSTRUCTION EQUIPMENT

(75) Inventors: Masami Naruse, Hirakata (JP); Naritoshi Ohtsukasa, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/387,944

(22) Filed: Mar. 13, 2003

(65) Prior Publication Data

US 2003/0226291 A1 Dec. 11, 2003

(30) Foreign Application Priority Data

Jun. 5, 2002 (JP) ..... 2002-164597

(51) Int. Cl.[7] ..... E02F 5/02; G05D 1/02

(52) U.S. Cl. ..... 37/348; 37/414; 701/50; 60/420; 60/431

(58) Field of Search ..... 37/348, 347, 410, 37/414, 466; 701/50; 60/400, 420, 431

(56) References Cited

U.S. PATENT DOCUMENTS 4,833,798 A * 5/1989 Ehrich ..... 37/414
5,488,787 A * 2/1996 Aoyagi et al. ..... 37/348
6,199,307 B1 * 3/2001 Kagoshima et al. ..... 37/443
2002/0104239 A1 * 8/2002 Naruse et al. ..... 37/348

FOREIGN PATENT DOCUMENTS

JP 01-220706 * 9/1989
JP 05-214746 8/1993

* cited by examiner

*Primary Examiner*—Robert E. Pezzuto
*Assistant Examiner*—Thomas A Beach
(74) *Attorney, Agent, or Firm*—Frishauf, Holtz, Goodman & Chick, P.C.

(57) ABSTRACT

Hybrid powered construction equipment is capable of making effective use of the output energy of an engine; increasing operating speed while keeping noise level low, and assuring operation power more than the performance of the engine. To this end, the hybrid powered construction equipment has a hydraulic pump powered by the engine; hydraulic actuators activated by discharge oil from the hydraulic pump; a motor-generator working in conjunction with the engine; and a battery for storing electric power generated by the electric motor-generator, the construction equipment further comprising a power-up switch disposed in an operating lever or operation panel and a controller which inputs a signal released from the power-up switch, wherein the controller constantly controls the revolution speed of the engine in response to a signal from the power-up switch and controls the output torque of the electric motor-generator such that torque for assisting powering of the hydraulic pump is output.

4 Claims, 4 Drawing Sheets

(a)

(b)

HYBRID POWERED CONSTRUCTION EQUIPMENT

TECHNICAL FIELD

The present invention relates to hybrid powered construction equipment having a power-up function.

BACKGROUND ART

As a construction machine having a power-up function, a hydraulic excavating machine has been proposed in Japanese Patent Publication KOKAI Gazette No. 5-214746 associated with the application previously filed by the present applicant. This hydraulic excavating machine is comprised of a variable displacement hydraulic pump powered by an engine; an operating valve for controlling a flow of operating oil; and hydraulic actuators for activating the work implement and others, and is arranged such that the operating oil discharged from the hydraulic pump by the switching operation of the operating valve is fed to the hydraulic actuators thereby to operate the work implement and others. This hydraulic excavating machine includes a two-stage relief valve for fixing two maximum pressures for the hydraulic pump operated on a two-stage basis; a cut-off valve for fixing the maximum discharge pressure of the hydraulic pump before relief operation when the pressure of the two-stage relief valve is set to the lower set value; a capacity control system for the hydraulic pump; an absorbed torque displacement valve for controlling the absorbed torque of the hydraulic pump; and a power-up switch.

This hydraulic excavating machine is operated in the following way. By turning the power-up switch ON, controlled pressure from the control pressure source is supplied to the pressure setting cylinder to set the spring force for the two-stage relief valve, thereby to set the two-stage relief valve to the upper relief set value. By supplying the above controlled pressure to the pressure setting cylinder to set the spring force for the cut-off valve, the cut-off function (i.e., the function for decreasing the discharge rate of the hydraulic pump to reduce relief loss, when the discharge pressure of the hydraulic pump is close to the relief pressure) is stopped. By outputting an absorbed torque increasing signal to the absorbed torque variable valve through the controller for the absorbed torque variable valve and/or by outputting an engine output increasing signal to the governor driving unit through the controller for the governor driving unit, the absorbed torque of the hydraulic pump and/or engine output power are increased. In this hydraulic excavating machine, the operation power in the full speed range of the work implement can be increased through one-touch operation of the power-up switch.

The hydraulic excavating machine, however, presents the problem of increased relief loss during operation of the power-up switch, because it employs the two-stage relief valve as a means for increasing the absorbed torque of the hydraulic pump. Although absorbed horse power increases due to increased engine power, this is only the result of emergence of the potential horse power of the engine, and it is therefore impossible for the hydraulic excavating machine to increase operation power more than the full horse power of the engine. Another disadvantage is high noise generation caused by increasing the revolution speed of the engine to increase engine power.

The present invention has been directed to overcoming the foregoing drawbacks and a primary object of the invention is therefore to provide hybrid powered construction equipment capable of making effective use of the output energy of the engine; increasing operating speed while keeping noise level low, and assuring operation power equal to or more than the performance of the engine.

DISCLOSURE OF THE INVENTION

The foregoing object can be accomplished by hybrid powered construction equipment according to the invention having an engine; a hydraulic pump powered by the engine; hydraulic actuators activated by discharge oil from the hydraulic pump; an electric motor working in conjunction with the engine; a dynamo electric generator powered by the engine; and a battery for storing electric power generated by the dynamo electric generator, the construction equipment further comprising a power-up switch disposed in an operating lever or operation panel and a controller which inputs a signal released from the power-up switch, wherein the controller constantly controls the revolution speed of the engine in response to a signal from the power-up switch and controls the output torque of the electric motor such that torque for assisting powering of the hydraulic pump is output.

In the invention, if the work load of the hydraulic actuators is low and the absorbed torque (the torque of the engine which the hydraulic pump requires in order to drive the hydraulic actuators) of the hydraulic pump is smaller than the output torque of the engine, the extra output torque of the engine actuates the dynamo electric generator so that electric power is generated and this electric power is stored in the battery. In this way, the extra energy of the engine is recovered. If a signal which has been output in response to turning ON of the power-up switch is input to the controller, electric power supplied from the battery works on the electric motor to output torque for assistance in driving of the hydraulic pump, and this assisting torque is added to the output torque of the engine. With this arrangement, the output of the hydraulic actuators can be increased while keeping noise level low. Thus, the output energy of the engine can be effectively used for energy saving.

Preferably, in the invention, during the ON state of the power-up switch, the controller controls the output torque of the electric motor in such a way that the absorbed torque of the hydraulic pump is compared to the rated output point torque of the engine, and if it is determined that the absorbed torque is lower than the rated output point torque, assisting torque is generated up to the proximity of the rated output point torque. With this arrangement, the maximum flow rate of the hydraulic pump during low load operation can be increased (See FIG. 4(*a*)), so that operating speed can be increased.

Preferably, in the invention, during the ON state of the power-up switch, the controller controls the output torque of the electric motor in such a way that the absorbed torque of the hydraulic pump is compared to the rated output point torque of the engine, and if it is determined that the absorbed torque is equal to or in the vicinity of the rated output point torque, assisting torque is output in an amount which exceeds the rated output point torque. With this arrangement, the operation power equal to or higher than engine performance can be assured while maintaining the maximum flow rate of the hydraulic pump.

BEST MODE FOR CARRYING OUT THE INVENTION

Referring now to the accompanying drawings, hybrid powered construction equipment will be described according to a preferred embodiment of the invention. The present embodiment concerns an application of the invention to a hybrid powered hydraulic excavator which is one kind of hybrid powered construction equipment.

Figure 1:
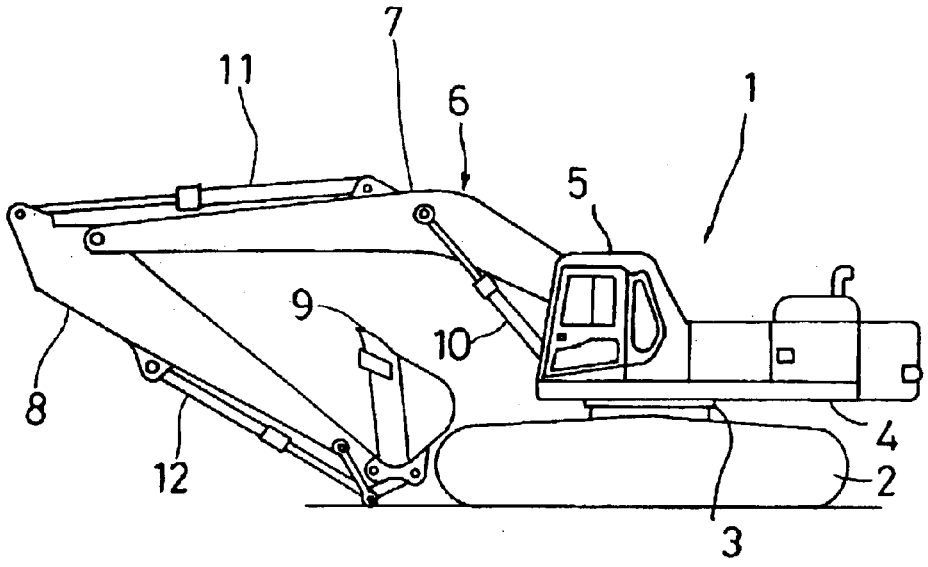
FIG. 1 is a side view of a hybrid powered hydraulic excavator according to one embodiment of the invention.
Figure 2:
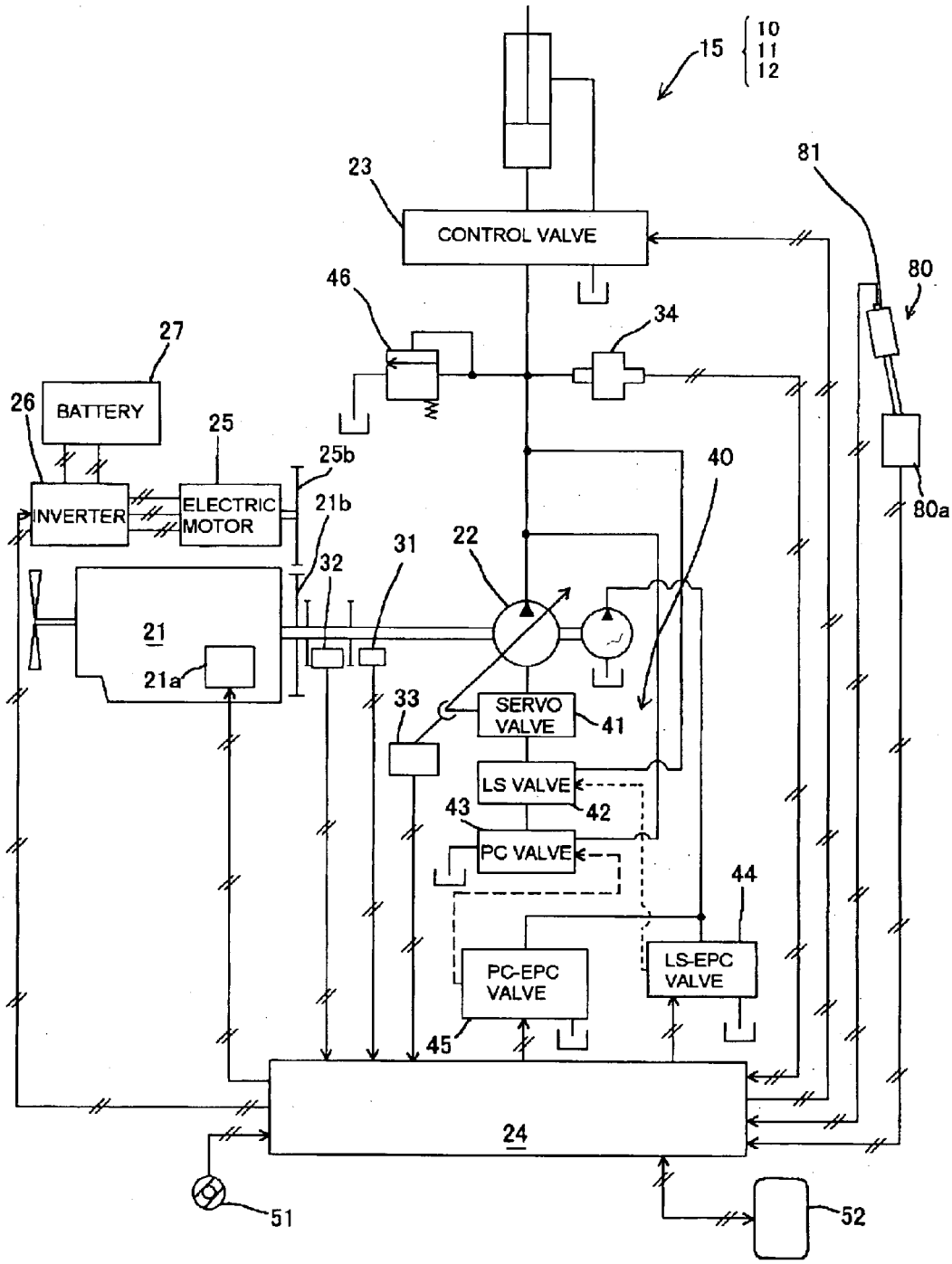
FIG. 2 is a block diagram of a hybrid system of the embodiment.

FIG. 1 shows a side view of a hybrid powered hydraulic excavator according to one embodiment of the invention. FIG. 2 is a block diagram of a hybrid system of the present embodiment.

The hybrid powered hydraulic excavator 1 of the present embodiment comprises, as shown in FIG. 1, an undercarriage 2, an upper structure 4 mounted on the undercarriage 2 through a rotating mechanism 3, and a work implement 6 attached to the upper structure 4. The work implement 6 is composed of a boom 7, an arm 8 and a bucket 9 which are pivotally coupled, being aligned in this order from the side of the upper structure 4. The boom 7, the arm 8 and the bucket 9 are pivotally driven by the expansion and contraction of a boom cylinder 10, an arm cylinder 11 and a bucket cylinder 12, respectively. The upper structure 4 is freely rotatable by driving a hydraulic motor (not shown). The upper structure 4 has a driver's cab 5 in which an operating system (not shown) for the operation of the boom, arm, bucket and others is installed.

As shown in FIG. 2, the hybrid powered hydraulic excavator 1 comprises an engine 21, a variable displacement hydraulic pump 22, a control valve 23 for controlling the flow of operating oil, and a controller 24 for controlling the operation of the control valve 23 and various instruments described later. In the hybrid powered hydraulic excavator 1, pressure oil discharged from the hydraulic pump 22 powered by the engine 21 is supplied to the hydraulic actuators (i.e., work implement actuators 15 such as the boom cylinder 10, the arm cylinder 11 and the bucket cylinder 12) and to a hydraulic motor (not shown) for running and rotating operations through the control valve 23. Reference numeral 46 designates a relief valve for fixing the maximum value of the discharge pressure of the hydraulic pump 22.

The engine 21 is equipped with a governor 21*a* for adjusting the revolution speed of the engine 21 according to increases and decreases in load. In operation, a signal which is indicative of a governor instruction on the rated engine speed and released from the controller 24 is input to the governor 21*a*. Thus, the engine 21 is constantly rotated with constant torque at a rated output point.

An electric motor 25 is mounted to the engine 21 through a gear 25*b* which is in mesh with the teeth formed on the periphery of a flywheel 21*b* (not shown). The electric motor 25 is an induction motor and also functions as a dynamo-electric generator. The electric motor 25 is switchable between a motor operation mode for assisting the engine 21 to activate the hydraulic pump and a generator operation mode for producing electric power using the engine 21 as a driving source. The electric motor 25 is connected to a battery 27 through an inverter 26 which controls the generator operation and motor operation of the electric motor 25 in response to an instruction from the controller 24. As the battery 27, a secondary battery such as lithium ion batteries may be used. Other than the secondary battery, a charge storage device such as a capacitor may also be used.

Detection signals from operation amount detectors (e.g., potentiometers) 80*a* are input to the controller 24, the detectors 80*a* being attached to work implement operating levers 80 such as a boom operating lever, an arm operating lever and a bucket operating lever. These operating levers 80 are provided in an operation system (not shown) in the driver's cab 5. In response to the input signals, the controller 24 controls the operation of the controller valve 23 to control the flow rate of pressure oil to be supplied to the associated work implement actuators 15. Any of the work implement operating levers 80 is provided with a knob switch 81 (corresponding to the power-up switch of the invention). When turning the knob switch 81 ON, the operation power is increased as described later during the ON state of the knob switch 81.

Input to the controller 24 are detection signals from a rotation sensor 31 for detecting the revolution speed of the engine 21, from a torque sensor 32 for detecting the output torque of the engine 21, from a swash plate angle sensor 33 for detecting the swash plate angle of the hydraulic pump 22, and from a pressure sensor 34 for detecting the discharge pressure of the hydraulic pump 22.

The hybrid powered hydraulic excavator 1 of the present embodiment employs a complex engine-pump control system in which the controller 24 obtains the optimum engine torque and optimum pump output according to jobs after any of the operation modes (heavy excavation, normal excavation, correction of track, fine operation, breaker, etc.) has been selected by an operation panel 52. In the complex engine-pump control system, the controller 24 detects a set revolution speed for the governor 21*a* preset by a fuel dial 51 and the actual revolution speed of the engine to perform control such that the best matching torque at each output point of the engine 21 is absorbed by the hydraulic pump 22, and performs isodynamic horse power control to make matching for a high fuel efficiency of the engine 21.

The hybrid powered hydraulic excavator 1 of the present embodiment employs a pump—valve control system. The pump—valve control system has (a) a servo valve 41 for tilt-rotation of the swash plate of the hydraulic pump 2; (b) an LS valve 42 for controlling the discharge rate based on the detected load of the work implement; (c) a PC valve 43 for making an adjustment such that the load of the work implement does not exceed engine horse power (pump output); (d) a swash plate angle driving means 40 composed of an LS valve electromagnetic selector valve (LS-EPC valve) 44 for applying pilot pressure to the LS valve 42 and to the PC valve 43 in response to an instruction from the controller 24 and a PC valve electromagnetic selector valve (PC-EPC valve) 45. This swash plate angle driving means 40 is designed to be operated in response to an instruction from the controller 24 based on the work load pressure of a pressure compensating valve (not shown), the delivery pressure of the hydraulic pump 22, and the operation amount of the work implement operating levers 80. In this way, the swash plate of the hydraulic pump 22 is tilt-rotated by the load imposed on the work implement actuators 15 and the swash plate angle driving means 40 which is operated in accordance with an instruction issued from the controller 24, so that the discharge rate of pressure oil from the hydraulic pump 22 is controlled. In the present embodiment, when the load increases during operation and this causes the discharge pressure of the hydraulic pump 22 to increase to a value near the relief pressure, the pressure sensor 34 detects it and the controller 24 issues a signal indicative of discharge rate reduction to reduce relief loss (i.e., the cut-off function).

Figure 3:
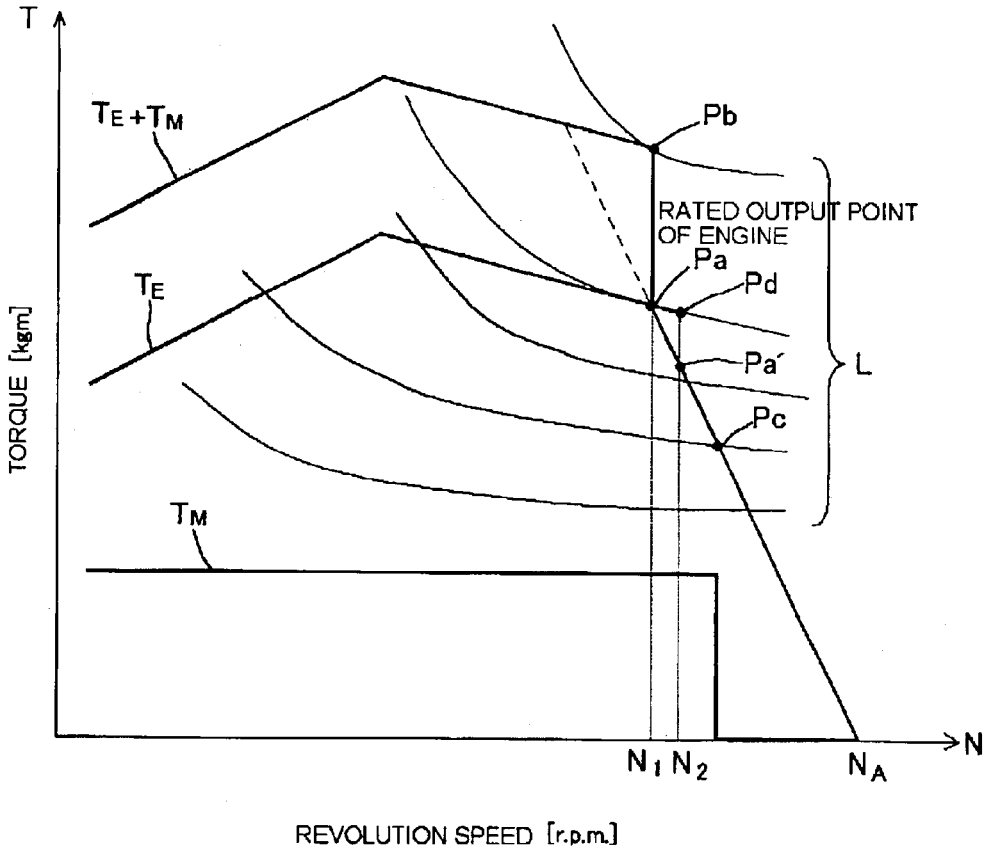
FIG. 3 is an output torque characteristic diagram of an engine and an electric motor.
Figure 4:
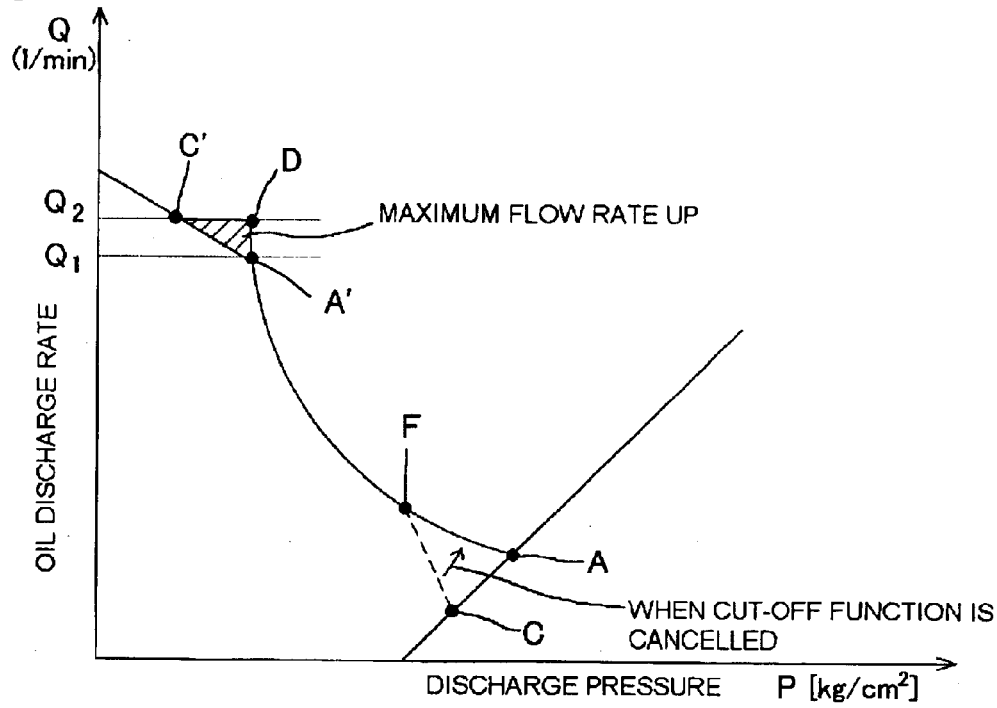
FIGS. 4(*a*) and 4(*b*) are hydraulic pump output torque characteristic diagrams.
Figure 4:
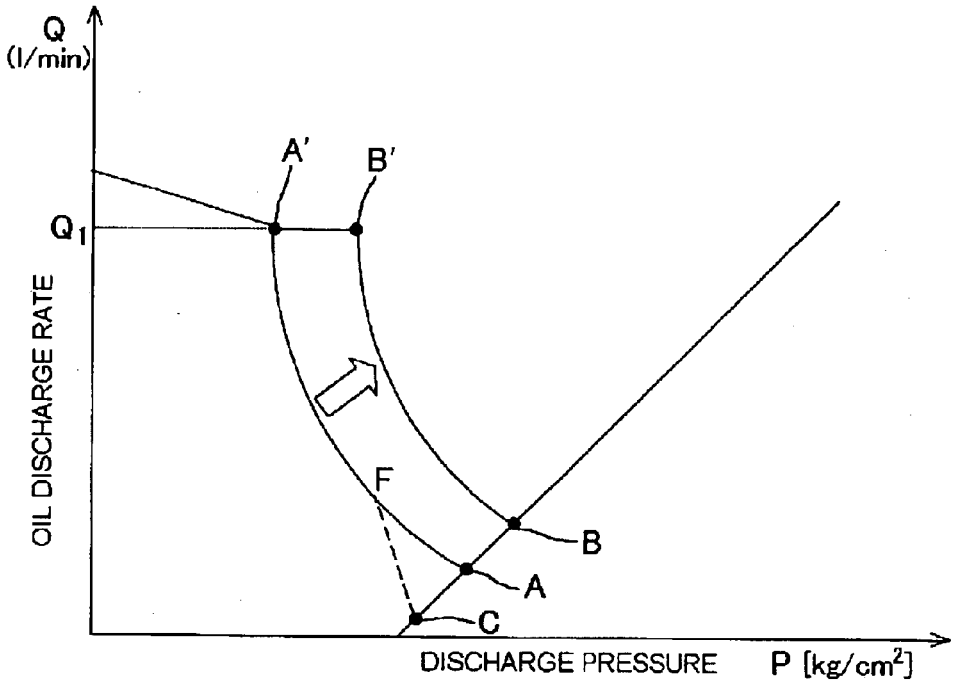

Reference is made to FIGS. 2 to 4 for explaining the operation of the hybrid powered hydraulic excavator 1 of the above-described structure according to the present embodiment. Herein, FIG. 3 shows an output torque characteristic diagram of the engine and the electric motor and FIG. 4 shows a hydraulic pump output characteristic diagram.

In operation, the controller 24 sends a governor instruction indicative of a rated engine speed $N_A$ to the governor 21*a*, so that the engine 21 has the engine torque characteristic indicated by the code $T_E$ in FIG. 3. The controller 24 controls the governor 21*a* such that the engine 21 is driven with the rated torque at the rated engine speed at the rated output point Pa of the engine torque characteristic. The isodynamic horse power control is performed such that matching between the absorbed torque of the hydraulic pump and the output torque of the engine 21 at the rated output point Pa is done by the above-described complex engine-pump control. Herein, "the absorbed torque" is the torque of the engine 21 which the hydraulic pump 22 requires in order to drive the hydraulic actuators, and "the isodynamic horse power control" is the control in which the discharge rate of the hydraulic pump 22 is controlled according to the curve PQ (isodynamic horse power curve) so that the absorbed torque at the matching point can be obtained. The curves designated by L in FIG. 3 are the isodynamic horse power curves of the engine 21.

If the work load is low and the absorbed torque of the hydraulic pump 22 is smaller than the output torque of the engine 21, the controller 24 allows the electric motor 25 to generate electric power from extra torque. More specifically, the controller 24 calculates the absorbed torque from the discharge pressure and swash plate angle of the hydraulic pump 22 and calculates extra torque from a comparison between the absorbed torque and the rated torque of the engine 21 and controls, through the inverter 26, the electric current flowing in the dynamo-electric motor 25 such that the extra torque works on the dynamo-electric motor 25 as power generation torque. The electric energy generated by the extra torque is stored in the battery 27. In this way, the output of the engine 21 is partially absorbed by the hydraulic pump 22 and consumed for the activation of the work implement and others. The remaining energy is absorbed by the power-generating dynamo-electric motor 25 and accumulated in the battery 27 as electric energy.

During operation, upon turning ON of the knob switch 81, the controller 24 cancels the aforesaid cut-off function and the absorbed torque of the hydraulic pump 22 is compared with the rated output point (the point Pa of FIG. 3) of the engine torque characteristic. As a result:

(1) If it is determined that the absorbed torque is at an arbitrary point (e.g., the point Pa' of FIG. 3) lower than the rated output point Pa, torque control for the electric motor 25 is effected through the inverter 26 such that the matching point is shifted from the rated output point Pa to the point Pd. Since this torque assisting operation is for applying only torque by the electric motor 25, it is carried out by the engine revolution speed constant control. As a result, the absorbed horse power characteristic of the hydraulic pump 22 varies, shifting from the pump characteristic indicated by the curve A'-F-C to the pump characteristic indicated by the curve D-A'-F-A (see FIG. 4(*a*)). The curve A-A' of FIG. 4(*a*) is the curve PQ of the hydraulic pump 22 when the rated output point Pa of the engine torque curve $T_E$ in FIG. 3 is the matching point. The point D is the intersection of the line representative of the oil discharge rate $Q_2$ at the point C' and the elongation of the curve A-A'.

As seen from FIG. 3, if the matching point is shifted from the output point Pa' to the output point Pa on the engine torque curve $T_E$ through the complex engine—pump control in order to increase the pump absorbed torque, the engine revolution speed decreases from $N_2$ to $N_1$, accompanied by a decrease in the discharge rate of the hydraulic pump 22. Therefore, the following relationship holds: Oil discharge rate $Q_2$ at the point C' of FIG. 4(*a*)>Oil discharge rate $Q_1$ at the point A' of FIG. 4(*a*). However, the present embodiment is arranged, as seen from FIG. 3, such that torque application by the electric motor 25 is carried out by the engine revolution speed constant ($N=N_2$) control from the output point Pa' to the output point Pd in the vicinity of the output point Pa, and therefore, the discharge rate of the hydraulic pump 22 does not drop and the pump output characteristic indicated by the curve A-D is obtained. Thus, the flow rate corresponding to the zone enclosed by the points A', C', D can be increased. Hence, if the knob switch 81 is turned ON during low-load operation such as rough scooping, the maximum flow rate is increased by the engine revolution speed constant control so that the operating speed of the work implement 6 can be increased while keeping noise level low.

On the other hand, after the controller 24 has made a comparison between the absorbed torque of the hydraulic pump 22 and the rated output point (the point Pa of FIG. 3) of the engine 21, (2) if it is determined that the absorbed torque of the hydraulic pump 22 has a value equal to or in the vicinity of the rated output point Pa, the controller 24 performs, while maintaining the revolution speed of the engine 21, torque control of the electric motor 25 through the inverter 26 such that torque application is carried out up to, for instance, the point Pb of FIG. 3, exceeding the rated output point Pa. This torque assisting operation is such that only torque is applied by the electric motor 25 and therefore, it is done through the engine revolution speed constant ($N=N_1$) control. This increases the absorbed horse power of the hydraulic pump 22 so that the pump characteristic indicated by the curve A-A' of FIG. 4(*b*) shifts to the pump characteristic indicated by the curve B-B' of the same, the curve B-B' passing the point B' which also passes the line A'-B' representative of the constant flow rate at the discharge rate $Q_1$. It should be noted that the curve A-A' of FIG. 4(*b*) represents the curve PQ of the hydraulic pump 22, the curve PQ having the matching point at the rated output point Pa of the engine torque curve $T_E$ of FIG. 3. It should be also noted that the curve B-B' of FIG. 4(*b*) represents the curve PQ of the hydraulic pump 22, the curve PQ having the matching point at the rated output point Pb of the torque curve ($T_E+T_M$) which is obtained by adding the torque curve $T_M$ of the electric motor 25 to the engine torque curve $T_E$ of FIG. 3. Therefore, if the knob switch 81 is turned ON to dig out a buried rock during heavy excavation for example, the controller 24 increases assisting torque in a specified amount through the torque control of the electric motor 25 thereby increasing the absorbed horse power of the hydraulic pump 22, while continuing the engine revolution speed constant control. This makes it possible to attain excavation power equal to or higher than the performance of the engine.

In the present embodiment, since the pump absorbed torque is increased by the torque assisting operation of the electric motor 25, the two-stage relief valve such as used in the prior art is no longer necessary, so that a simplified hydraulic circuit can be achieved and relief loss can be reduced during powering-up.

While the present embodiment is associated with a case where the torque assisting operation of the electric motor 25 is effected by turning the knob switch 81 ON, the invention is not limited to this but may be modified in such a way that a switch exclusive to the operation panel 52 is provided and the torque assisting operation of the electric motor 25 is effected by operating this switch.

What is claimed is:

1. A hybrid powered construction machine comprising:

an engine;

a hydraulic pump powered by the engine;

hydraulic actuators activated by discharge oil from the hydraulic pump;

an electric motor which works in conjunction with the engine;

a dynamo electric generator powered by the engine;

a battery for storing electric power generated by the dynamo electric generator;

a power-up switch disposed in one of an operating lever and an operation panel; and a controller which constantly controls a revolution speed of the engine in response to a signal from the power-up switch, and controls an output torque of the electric motor such that torque for assisting powering of the hydraulic pump is outputted.

2. The hybrid powered construction machine according to claim 1, wherein during an ON state of the power-up switch, the controller controls the output torque of the electric motor in such a way that an absorbed torque of the hydraulic pump is compared to a rated output point torque of the engine, and if it is determined that the absorbed torque is lower than the rated output point torque, assisting torque is generated up to a proximity of the rated output point torque.

3. The hybrid powered construction machine according to claim 1, wherein during an ON state of the power-up switch, the controller controls the output torque of the electric motor in such a way that an absorbed torque of the hydraulic pump is compared to a rated output point torque of the engine, and if it is determined that the absorbed torque is equal to or in a vicinity the rated output point torque, assisting torque is outputted in an amount which exceeds the rated output point torque.

4. The hybrid powered construction machine according to claim 1, wherein the electric motor and the dynamo electric generator are provided as a single unit which is switchable between a motor operation mode and a generator operation mode.

* * * * *